US005081780A

United States Patent [19]

Lishness et al.

[11] Patent Number: 5,081,780

[45] Date of Patent: Jan. 21, 1992

[54] FIRING PIN POSITIONING SYSTEM

[75] Inventors: Bryant L. Lishness, Bristol; Paul A. Scirica, East Hampton, both of Conn.

[73] Assignee: Colt's Manufacturing Company Inc., West Hartford, Conn.

[21] Appl. No.: 627,595

[22] Filed: Dec. 14, 1990

[51] Int. Cl.[5] ..... F41A 19/00

[52] U.S. Cl. ..... 42/69.01; 89/177; 89/198; 89/199; 267/180

[58] Field of Search ..... 42/69.01, 69.02, 69.03, 42/70.08; 89/177, 178, 198, 199, 44.01; 267/180

[56] References Cited

U.S. PATENT DOCUMENTS

| | | | |
|---|---|---|---|
| 3,589,226 | 5/1971 | Shadowens | 267/180 |
| 4,031,648 | 6/1977 | Thomas | 42/70.01 |
| 4,090,316 | 5/1978 | Volkmar | 42/70.06 |

FOREIGN PATENT DOCUMENTS

| | | | |
|---|---|---|---|
| 0752307 | 9/1933 | France | 267/180 |
| 0983846 | 6/1951 | France | 42/69.02 |
| 0224674 | 12/1942 | Switzerland | 89/198 |

*Primary Examiner*—Michael J. Carone
*Attorney, Agent, or Firm*—Perman & Green

[57] ABSTRACT

A system for movably positioning a first member relative to a second member. The system has a hole in the first member and a coiled spring/plunger member positioned in the hole. The coiled member has a section that extends out of the hole that does not possess significant spring properties and thus can act as a plunger. The plunger section of the coiled member can be moved in and out of an aperture to the hole without risk of damage. Thus, the second member can be moved relative to the first member by compressing the coiled member or moving away from the coiled member and, the coiled member can position the second member relative to the first member while at rest.

20 Claims, 1 Drawing Sheet

FIRING PIN POSITIONING SYSTEM

BACKGROUND OF THE INVENTION

1. Field of the Invention

The present invention relates to spring positioners and, more particularly, to a positioning system for a firearm.

2. Prior Art

In the firearms industry positioning systems comprising holes in a frame having coil springs and plungers adapted to move in and out of the holes have been used for a number of years. Coiled springs have also been used for a number of years to space firing pins rearwardly to maintain a safe spacing between the tip of the firing pin and the primer of a cartridge as disclosed in U.S. Pat. No. 4,031,648.

A problem exists with prior art positioning systems in that coiled spring and plunger assemblies also require an addition hole to be drilled in the frame and a retaining pin inserted to prevent the plunger and spring from falling out of their hole. This increases the time it takes to manufacture and repair a firearm and increases the cost of manufacturing and repairing the firearm.

A further problem exists in that an ordinary coil spring, such as in U.S. Pat. No. 4,031,648, cannot be used to position a firing pin in a slightly retracted position when the portion of the firing pin that is intended to contact a cartridge is located off center to the rest of the firing pin assembly.

It is therefore an objective of the present invention to provide a new and improved spring positioner system for use in a firearm that will overcome problems in the prior art and provide additional features.

SUMMARY OF THE INVENTION

The foregoing problems are overcome and other advantages are provided by a new and improved positioning system.

In accordance with one embodiment of the present invention, a system for movably positioning a first member relative to a second member in a firearm is provided. The system comprises a longitudinal hole in the first member of the firearm having an aperture thereinto. The system further comprises a positioner for positioning the second member at a predetermined position from the first member while at rest. The positioner is comprised of a longitudinally coiled member with a first spring section having portions of the coiled member spaced from each other and a second section having portions of the coil member located next to each other. The coiled member has a length greater than the hole and is located therein with the first section in the hole and the second section extending out of the hole at the aperture. The positioner can be compressed into the hole, at least partially, when the second member is advanced towards the aperture, and the positioner can return the second member to its rest position.

In accordance with another embodiment of the present invention, in a firing pin return system for a firearm, the firearm having a slide and a firing pin assembly located in a cavity of the firearm, the firing pin assembly having a firing pin, a case having the firing pin connected thereto, and a spring for biasing the case forward towards at least a predetermined location in front of a front wall of the cavity, the improvement comprising a single firing pin return spring. The return spring is located in a hole in the slide and extends out of the hole and into contact with the case such that the case is spaced from the front wall of the cavity by the return spring in a home position. The return spring has a length longer than the hole with a first coiled spring section in the hole and a second coiled non spring section that extends out of the hole to contact the case such that the return spring can be compressed into the hole by the case, at least partially, without substantial risk of damage to the return spring and, can return the case back to its home position.

In accordance with another embodiment of the present invention a firearm is provided comprising a frame with a slide, a trigger assembly connected to the frame, a firing pin assembly connected to the frame and operably connected with the trigger assembly, the firing pin assembly having a firing pin, and means for positioning the firing pin in the slide at a home position. The means for positioning includes a firing pin return spring comprised of a single coiled member having a spaced coil spring section located in a hole of the slide and a compact coil section adapted to transfer forces between the spring section and the firing pin. The compact coil section spans a gap in the slide between the firing pin assembly and the slide, and is adapted to be moved into and out of the hole.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
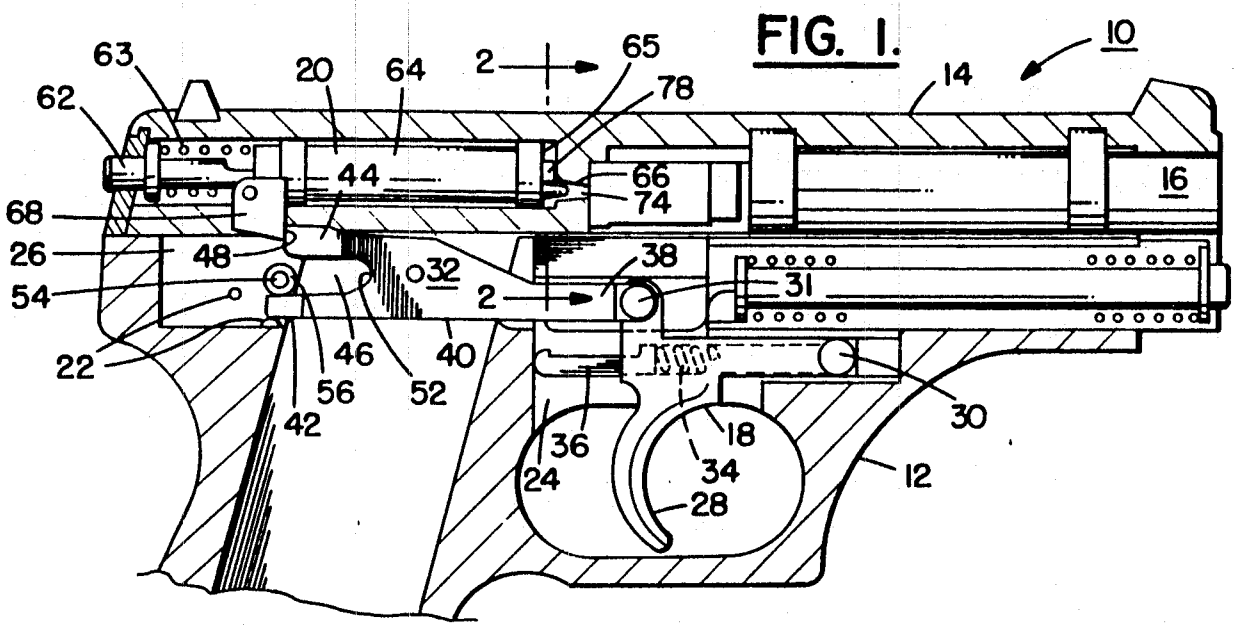
FIG. 1 is a schematic cross-sectional view of a pistol incorporating features of the present invention.

Referring to FIG. 1, there is shown a partial schematic cross-sectional view of a pistol 10 incorporating features of the present invention. Although the present invention will be described with reference to the embodiment shown in the drawings, it should be understood that the present invention can be incorporated into different types of embodiments and may be used with different types of firearms and trigger assemblies. In addition, any suitable size, shape and type of elements or materials could be used.

The pistol 10 generally comprises a frame 12, a slide 14, a barrel 16, a trigger assembly 18, and a firing pin assembly 20. The pistol 10 is similar to a pistol disclosed in U.S. patent application Ser. No. 447,601 filed Dec. 8, 1989 which is incorporated by reference in its entirety herein. Fixedly connected to the frame 12 and operably positioned relative to the trigger assembly 18 are sear locating or positioning plungers 22 and roller 56. The frame 12 may be comprised of any suitable material such as metal or plastic. The frame 12 has a trigger cavity 24 and a sear cavity 26. The trigger assembly 18 comprises a trigger 28, roller bearings 30 and 31, and sear 32. However, any suitable type of trigger assembly could be provided. The trigger 28 is movably mounted in the trigger cavity 24 for linear longitudinal movement therein supported by roller bearings 30 and 31. Spring 34 and plunger 36 bias the trigger 28 in a forward position. The sear 32 is pivotally connected to the trigger 28 proximate roller bearing 31.

The sear 32 generally comprises a first forward section 38 connected to the trigger 28 and a second rearward section 40 having a bottom leg 42, a top leg 44, and a groove 46 therebetween. However, any suitable type of sear could be provided. The top leg 44 has a sear surface 48. The bottom leg 42 has a plunger ramp on one side. The rearward section 40 also has a roller cam surface 52 in the groove 46. The sear 32 is adapted to longitudinally move with the trigger 28, but can be pivoted relative thereto proximate roller bearing 31. Fixedly mounted to the frame 12, in the sear cavity 26, is a roller pin 54 with a cam roller 56 connected thereto. The rearward section 40 of the sear 32 is operably positioned in the sear cavity 24 such that the sear 32 can move relative to the roller 56 with the roller 56 in the groove 46.

The firing pin assembly 20 has a spring unit 62, an outer case 64, a firing pin 66 at the front of the case 64, and a sear 68 fixedly connected to the case 64. However, any suitable type of firing pin assembly could be provided. The sear 68 can be moved back by the sear 32 as the trigger 28 is pulled. The sear 68, in turn, can move the case 64 and firing pin 66 therewith. When the two sears 32 and 68 are disengaged from each other, at the full rear movement of the trigger 28, the spring unit 62 can propel the case 64 and firing pin 66 forward to impact upon and fire a cartridge.

Figure 2:
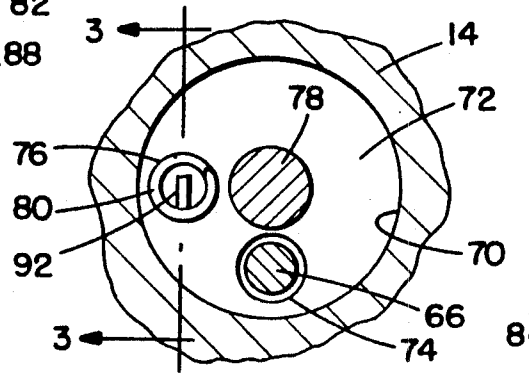
FIG. 2 is an enlarged partial cross-sectional view of the pistol shown in FIG. 1 taken along line 2—2.

Referring also to FIG. 2, the slide 14 has a cavity 70 with the firing pin assembly 20 primarily located therein. The cavity 70 is generally circular in the embodiment shown and has a front face or wall 72. The front face 72 has two holes therein; a firing pin hole 74 and a positioning spring hole 76. The firing pin hole 74 is suitably sized and shaped to allow the firing pin 66 to be positioned in the hole 74 and contact the rear of a cartridge to fire the cartridge. In a preferred embodiment the firing pin hole 74 is tapered such that the firing pin will be stopped by contact with the interior wall of the hole 74 at a predetermined location.

The case 64, with firing pin extending from its front 65 and fixed thereto, is positioned at the home position shown in FIG. 1 by the cooperating actions of the spring unit 62 and a forward positioner 80. The case 64 is movably mounted over the spring unit 62 with a forward extension 78 of the spring unit 62 passing through a hole in the case front 65. The spring unit 62 has a forward ledge (not shown) located inside the case 64 proximate the front wall 65 of the case 64 that the case can push against and can push against the case 64. The forward extension 78 normally rests against the slide cavity front face 72 due to the biasing action of spring unit spring 63 at a home or rest position. Thus, in the home position, the spring unit case ledge (not shown) is set at a predetermined position relative to the cavity wall 72. This limits rearward movement of the case 64 at the home position unless the spring unit spring 63 is compressed.

Figure 3:
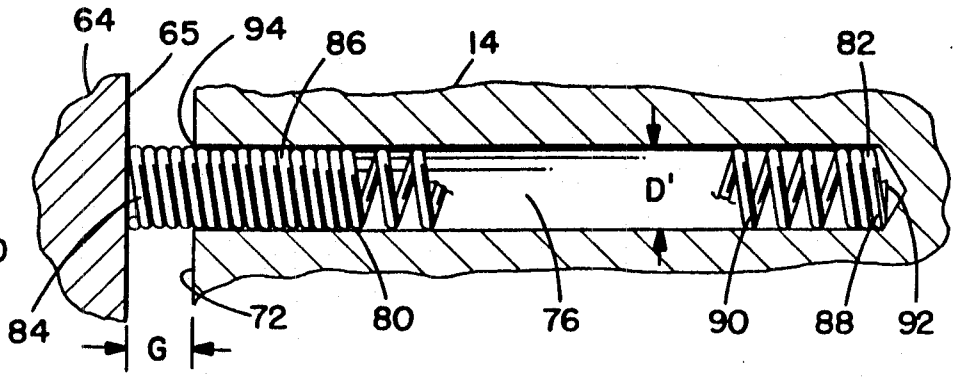
FIG. 3 is a partial cross-sectional view taken along line 3—3 of FIG. 2.
Figure 4:
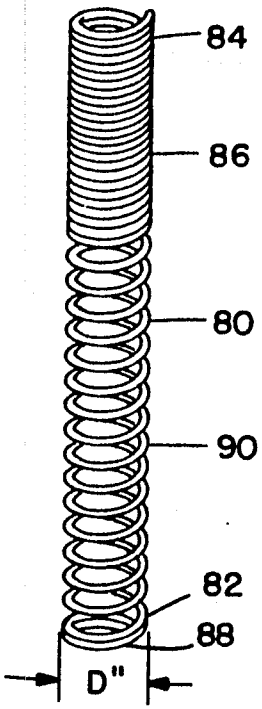
FIG. 4 is a perspective view of a spring incorporating features of the present invention.

Referring also to FIGS. 3 and 4, in the home position, the front 65 of the case 64 is spaced a predetermined distance G from the slide cavity wall 72. This spacing or gap G is generally provided such that the firing pin 66 is spaced from a cartridge in the home position, but when the case is advanced a predetermined distance equal to or less than gap distance G, the firing pin 66 can fire a cartridge. Since the spring unit 62 only limits rearward movement of the case 64 at the home or rest position, the forward positioner 80 is provided to bias the case 64 against the spring unit case ledge (not shown) to prevent the case from moving forward from the home, position except as described below.

The forward positioning hole or positioner spring hole 76 is a blind hole with a uniform diameter. The positioner 80, in the embodiment shown, is comprised of a single coiled member having a first end 82, a second end 84, and a general elongate tube shape therebetween. In a preferred embodiment, the coiled number is comprised of tempered steel. However, any suitable type or combination of materials could be provided. In the embodiment shown, the positioner 80 generally has three sections, a plunger section 86 at the second end 84, an enlarged coil section 88 at the first end 82, and a spring section 90 therebetween. The first end 82 also has a tail 92 as will be explained below.

The plunger section 86 generally comprises adjacent portions of the coiled member contacting each other to form a tube shape without any substantial spring properties. The spring section 90 has adjacent portions of the coiled member spaced from each other such that the spring section 90 can function as a coil spring between the plunger section 86 and the first end 82. Both the plunger section 86 and the spring section 90 have an outer diameter D that is slightly smaller than the diameter D' of the spring hole 76. The enlarged coil section 88 has adjacent portions of the coiled member located adjacent each other without spaces therebetween, but unlike the other two sections 86 and 90, has an outer diameter D" that is larger than the spring hole diameter D' before insertion into the spring hole 76. This enlarged coil section 88 is used to fixedly mount the positioner 80 in the hole 76.

In order to assemble the positioner 80 with the slide of the firearm 10, the first end 82 is placed at the aperture 94 to the hole 76 in the cavity 70. An elongate insertion tool (not shown), such as a rod, is inserted into the center channel of the coiled positioner 80 at the second end 84 and positioned all the way through the positioner 80 to contact the tail 92. The insertion tool is then pushed into the positioner hole 76. The insertion tool pushes against the tail 92 which causes the third section to be pulled via the tail 92 into the positioner hole 76, longitudinally expanding slightly, which also causes the enlarged coil section 88 to have its outer diameter to be reduced. This allows the enlarged coil section to press into the hole 76. In the embodiment shown, the insertion tool is used to push the first end 82 of the positioner 80 all the way to the back of the hole 76. The tool is then removed. Once the insertion tool stops pushing on the tail 92, the enlarged coil section 88, no longer being pulled by the tail 92, attempts to resume its enlarged coil shape as shown in FIG. 4. However, because the diameter D' of the hole 76 is less than the natural diameter D" of the enlarged coil section 88, the enlarged coil section 88 expands against the wall of the hole 76 to form a friction hold of the positioner 80 with the slide 14 in the hole 76. This friction hold is sufficient to keep the positioner 80 mounted to the slide 14 for normal operation of the pistol 10, but can be removed from the hole 76, for cleaning or replacement, by applying a suitable amount of tensile pull on the second end 84 to overcome the friction hold at the first end 82.

In the preferred embodiment shown, the positioner hole 76 is about 1.3 inches long. The spring section 90 is about one inch long and the plunger section 86 is about one half inch long. Thus, the positioner 80 is longer than the hole 76 with the plunger section 86 extending through the hole opening 94 and into the cavity 70. However, any suitable lengths could be provided. In the home or rest position shown in FIGS. 1 and 3, the second end 84 of the positioner 80 abuts against the front 65 of the case 64, with the spring section 90 being slightly compressed. Thus, the positioner 80 biases the case 64 against the case ledge (not shown) of the spring unit 62. Hence, the positioner 80 and spring unit 62 cooperate with each other to position the case 64 at its home position with the gap G between the front 65 of the case 64 and the wall 72 of the slide cavity 70. In the preferred embodiment shown, the spring section 90 of the positioner 80 is weaker than the spring unit spring 63 so as not being capable of pushing the front end 78 of the spring unit 62 off of the front wall 72 of the cavity 70.

The operation of the pistol 10 and its firing pin positioning system will now be described. With the case 64 and firing pin 66 in their home positions, a cartridge can be loaded into the rear end of the barrel 16. Because the positioner biases the case 64 and attached firing pin 66 in their slightly retracted home position, there is no risk of the firing pin 66 contacting and accidentally discharging the cartridge. In order to fire the pistol 10, the operator can pull on the trigger 28. This moves the sear 32 rearward. The sear 32 moves the firing pin assembly sear 68 rearward which, because it is connected to the case 64, pulls the case 64 and firing pin 66 rearward. As the case 64 is moved rearward, the spring unit 62 compresses. Because the positioner 80 is friction held in the hole 76, it remains in its position on the slide 14. Eventually, the roller 56 and cam surface 52 cooperate to pivot the rear end 40 of the sear 32 down resulting in disengagement of the two sears 32 and 68. This allows the case 64 to be propelled forward by the compressed spring unit 62. The firing pin assembly 20 passes through its home position as it advances to fire a cartridge with the spring unit 62 stopping at the home position due to the contact of the front end 78 with the front wall 72 of the cavity 70. Although the spring unit 62 is stopped at its home position and the positioner 80 once again contacts the front 65 of the case 64, because of the relatively fast speed of the case 64, the inertia of the case 64 causes the case 64 to continue its forward motion past the home position wherein the firing pin 66 impacts the cartridge.

During the forward inertial travel of the case 64 and firing pin 66, the force exerted against the second end 84 of the positioner 80 is sufficient to cause the positioner 80 to be compressed between the case 64 and the rear end of the hole 76. Basically, although the first end 82 remains stationary in the hole 76, the plunger section 86 is moved such that a greater amount or length of the plunger section 86 is located in the 76 as the gap G gets smaller. The spring section 90 acts as a coil spring to absorb the displacement or movement of the plunger section 86, thus storing potential energy. After the case 64 and firing pin 66 are stopped at their battery position by contact with the slide 14, the forward inertial motion of the case 64 and firing pin 66 is lost. Because the spring section 90 is compressed, its potential energy is translated to kinetic energy by moving the plunger section 86 rearward which moves the case 64 and firing pin 66 rearward until the case 64 once again contacts the spring unit case ledge and is thus positioned at its home position again.

The advantages over the prior art should be clearly evident from the above description of the preferred embodiment. Unlike prior art positioners, the present invention can be employed with only one coiled member. No additional means need be provided to fixedly mount the positioner with the slide. Because of the compact wind of the coil member at the plunger section, there is virtually no risk of potential damage to the positioner as the plunger section is moved back and forth in the aperture to its hole. Manufacture, assembly, cleaning, repair, and reliability, are improved and, costs and labor for these are also reduced. Although friction mounted is described above, it should be understood that any suitable mounting could be provided. In addition, the positioner of the present invention is not limited to pistols, but may also be used for other types of firearms including rifles. The present invention can also be used for applications other than firing pin positioning.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A system for movably positioning a first member relative to a second member in a firearm, the system comprising:

a longitudinal hole in the first member of the firearm having an aperture thereinto; and a positioner for positioning the second member at a predetermined position from said aperture while at rest, said positioner being comprised of a longitudinal coiled member with a first spring section having portions of said coiled member spaced from each other and a second section having portions of said coiled member located next to each other, said coiled member having a length greater than said hole and being located therein with said first section in said hole and said second section extending out of said hole at said aperture, wherein said positioner and hole are adapted to position the second member at a rest position, said positioner can be compressed into said hole, at least partially, when the second member is advanced towards said aperture and said positioner can return the second member to its rest position

2. A system as in claim 1 wherein said hole is suitably sized and shaped to prevent said positioner from bending out of its longitudinal shape.

3. A system as in claim 1 wherein said second section is adapted to prevent said spring from bending out of its longitudinal shape at said second section.

4. A system as in claim 1 wherein said first section is about one inch long.

5. A system as in claim 1 wherein said second section is about one-half inch long.

6. A system as in claim 4 wherein said hole is about 1.3 inches long.

7. A system as in claim 1 wherein said coiled member further comprises a third section opposite said second section.

8. A system as in claim 7 wherein said third section is comprised of an enlarged coil section that is compressed into said hole to friction hold said positioner in said hole.

9. A system as in claim 7 wherein said third section comprises a mounting tail.

10. In a firing pin return system for a firearm, the firearm having a slide and firing pin assembly located in a cavity of the firearm, the firing pin assembly having a firing pin, a case having the firing pin connected thereto, and a spring for biasing the case forward towards at least a predetermined location in front of a front wall of the cavity, the improvement comprising:

a firing pin return spring, the return spring being located in a hole in the slide and extending out of the hole and into contact with the case such that the case is spaced from the front wall of the cavity by the return spring in a home position, the return spring having a length longer than the hole with a first coiled spring section in the hole and a second coiled non-spring section that extends out of the hole to contact the case such that the return spring can be compressed into the hole by the case, at least partially, without substantial risk of damage to the return spring and, can return the case back to its home position.

11. In a system as in claim 10 wherein the second section is comprises of a compressed coil section wherein adjacent sections of the coil touch each other.

12. In a system as in claim 10 wherein the second section is adapted to transfer forces directly between the first section and the case.

13. In a system as in claim 10 further comprising means for fixedly connecting said return spring in the hole.

14. In a system as in claim 10 wherein said second section is adapted to move at an opening to the hole in a linear path.

15. A firearm comprising:

a frame with a slide;

a trigger assembly connected to said frame;

a firing pin assembly connected to said frame and operably connected with said trigger assembly, said firing pin assembly having a firing pin; and means for positioning said firing pin in said slide at a home position, said means for positioning including a firing pin return spring comprised of a single coiled member having a spaced coil spring section located in a hole of said slide and a compact coil section adapted to transfer forces between said spring section and said firing pin, said compact coil section spanning a gap in said slide and adapted to be moved into and out of said hole.

16. A firearm as in claim 15 wherein said firing pin assembly includes a case with said firing pin connected thereto, said return spring contacting said case to space said case in said slide at a home position.

17. A firearm as in claim 15 wherein said compact coiled section comprises adjacent portions of said coiled member touching each other.

18. A firearm as in claim 15 further comprising means for fixedly connecting said coiled member in said hole.

19. A firearm as in claim 15 wherein said coiled member has a general longitudinal shape and said hole is adapted to maintain said shape while said member is moved therein.

20. A firearm as in claim 18 wherein said means for fixedly connecting comprises an enlarged coil section of said member that is compressed into said hole to friction hold said member in said hole.

* * * * *